United States Patent [19]

Haas

[11] Patent Number: 4,554,968

[45] Date of Patent: Nov. 26, 1985

[54] WRAPPED FIN HEAT EXCHANGER CIRCUITING

[75] Inventor: Rudy E. Haas, East Syracuse, N.Y.

[73] Assignee: Carrier Corporation, Syracuse, N.Y.

[21] Appl. No.: 344,141

[22] Filed: Jan. 29, 1982

[51] Int. Cl.[4] ..... F28F 9/26; F28F 17/00; F25B 13/00

[52] U.S. Cl. ..... 165/144; 165/125; 165/172; 165/176; 62/324.5

[58] Field of Search ..... 165/162, 125, 144, 181, 165/172, 175, 176; 62/324.1, 324.4, 324.6, 324.5

[56] References Cited

U.S. PATENT DOCUMENTS

| | | | |
|---|---|---|---|
| 2,298,712 | 9/1961 | Watkins . | |
| 2,454,654 | 11/1948 | Kaufman | 165/125 |
| 2,508,247 | 5/1950 | Giauque | 165/162 |
| 2,638,757 | 5/1953 | Borgerd | 165/125 |
| 2,669,099 | 2/1954 | Malkoff | 165/144 |
| 3,024,620 | 3/1962 | Burnett . | |
| 3,041,845 | 7/1962 | Trask . | |
| 3,077,226 | 2/1963 | Matheny | 165/125 |
| 3,142,970 | 8/1964 | Hale | 62/324.1 |
| 3,150,501 | 9/1964 | Moore . | |
| 3,289,428 | 12/1966 | Haines . | |
| 3,508,417 | 4/1970 | Kimura | 165/125 |
| 3,529,659 | 9/1970 | Trask . | |
| 3,631,873 | 1/1972 | Swithenbank et al. . | |
| 3,731,497 | 5/1973 | Ewing . | |
| 4,057,975 | 11/1977 | Del Toro et al. . | |
| 4,057,977 | 11/1977 | Chambless . | |
| 4,089,368 | 5/1978 | Bell, Jr. et al. . | |
| 4,171,622 | 10/1979 | Yamaguchi | 62/160 |
| 4,380,263 | 4/1983 | Wright | 165/125 |

*Primary Examiner*—William R. Cline
*Assistant Examiner*—John K. Ford
*Attorney, Agent, or Firm*—Dana F. Bigelow

[57] ABSTRACT

A wrapped fin heat exchanger having a plurality of circuits is disclosed. A bottom circuit of the wrapped fin heat exchanger is arranged in multiple rows and has circuiting to provide hot gaseous refrigerant to the areas of highest frost concentration during operation in the defrost mode. The circuiting allows for hot gaseous refrigerant to enter the inner loop and then flow downwardly to the bottom of the coil where the highest frost accumulation is concentrated. Refrigerant then flows upwardly through the outer row of the coil to an intermediate transition loop. The refrigerant then flows upwardly through the inner row and then back to the outer row and downwardly to an inner stop loop before being connected to the header. Hence, by circuiting the heat exchanger in the appropriate configuration it is possible to achieve the optimal frost melting and heat transfer arrangement.

1 Claim, 3 Drawing Figures

WRAPPED FIN HEAT EXCHANGER CIRCUITING

BACKGROUND OF THE INVENTION

1. Field of the Invention

This invention relates to a wrapped fin heat exchanger wherein the heat exchanger is divided into a plurality of specific circuits. More particularly, the present invention relates to the arrangement of loops forming a circuit for a wrapped fin heat exchanger including both an inner set of loops and an outer set of loops. The loops are arranged to promote defrost when refrigerant is circulated through the heat exchanger during a defrost cycle.

2. Prior Art

In many air conditioning and refrigeration applications a heat exchanger is used under conditions wherein water is deposited on the heat exchange surfaces. For example, the outdoor heat exchanger of a heat pump operating in the heating mode serves as an evaporator absorbing heat energy from ambient air being circulated thereover. As the ambient air temperature is decreased its ability to hold water vapor is additionally decreased and excess water vapor will be condensed and deposited on the heat exchange surface as water. If this surface is below freezing, ice will accumulate and the heat transfer efficiency between air and the heat exchanger surfaces will be diminished. In addition, if it is raining or snowing, this moisture may be drawn into the heat exchanger by its air handling apparatus or forced onto the heat exchanger surfaces by the wind.

In a cold room or other similar applications where an evaporator is operating below the freezing temperature of water to cool the air being supplied to the room a similar problem may occur. The reduction in temperature of the air being circulated over the heat exchanger below its dew point acts to condense out moisture which may freeze on the evaporator surfaces impeding heat transfer.

Most heat pump systems include means for eliminating frost from the coil surface. One of the most common means of defrost is to reverse the heat pump placing the heat pump system in the cooling mode of operation wherein heat energy is discharged to the outdoor coil then serving as a condenser. Heat energy is supplied by the hot gas from the compressor being circulated to the outdoor heat exchanger wherein it serves to raise the temperature of the heat exchanger and to melt the frost accumulated thereon.

It has been found in various heat exchangers that frost tends to accumulate towards the bottom of the heat exchanger. The accumulation at the bottom is especially acute since water vapor condensed on the surface of the heat exchanger tends to drip towards the bottom where it collects and is more likely to become frozen. The condensate from the air as it is cooled collects on all the circuits and thereafter tends to drip downwardly to the lower areas of the coil. As the frost accumulates it builds up on the lower areas of the coil not only effecting heat transfer between refrigerant flowing through the heat exchanger and air flowing thereover but actually may impede air flow between the heat transfer surfaces. Under some frost conditions it has been found that frost accumulates primarily on the outer row as well as on the bottom portion of the heat exchanger.

In order to effectively direct hot gaseous refrigerant to the location where the frost has accumulated the present invention provides for a circuiting arrangement in a wrapped fin type heat exchanger such that hot gaseous refrigerant is supplied directly to the lowermost portion of the coil and thereafter to the exterior surface of the coil to effect defrost. The refrigerant circuit is arranged such that the hot gaseous refrigerant is circulated first to the highest frost accumulating areas and thereafter to the lesser frost accumulating areas.

SUMMARY OF THE INVENTION

It is an object of the present invention to provide a heat exchange assembly effective to transfer heat energy between refrigerant flowing therethrough and air flowing thereover.

It is another object of the present invention to provide a wrapped fin type heat exchanger having a plurality of parallel circuits wherein the bottom circuit is configured to be most effective during defrost.

Another object of the present invention is to provide a circuiting arrangement for use in a wrapped fin type heat exchanger having both an inner set of loops of tubing and an outer set of loops of tubing, the refrigerant being supplied first to the inner set of loops such that it may be directed downwardly to effect defrost first in the highest frost accumulating region.

It is another object of the present invention to provide a heat exchanger which may be safely and efficiently assembled and acts to provide the advantages of directing hot gaseous refrigerant to the frosted area during defrost.

These and other objects of the present invention are achieved by using a wrapped fin heat exchanger for transferring heat energy between a fluid flowing through the heat exchanger and gas flowing thereover, said heat exchanger being formed from a continuous length of tubing having fin material wrapped thereabout. A plurality of circuits are formed from the wrapped fin tubing, at least one circuit being formed from a plurality of loops of tubing, said loops being arranged to have an inner set of loops and an outer set of loops. The first header is connected to the first end of each circuit and the second header is connected to the second end of each circuit. A bottom circuit is positioned vertically below the other circuits, said bottom circuit having inner and outer sets of loops arranged vertically and said circuit having exterior loops at the vertical ends of said circuit and at least one interior loop between the exterior loops. Means for connecting the first header to the first end of the bottom circuit at an inner interior loop and means for connecting a second header to a second end of the bottom circuit and an outer interior loop are provided.

DESCRIPTION OF THE PREFERRED EMBODIMENT

As set forth herein the preferred embodiment will be described in reference to the outdoor heat exchanger of an air conditioning system including a two row wrapped fin type heat exchanger having a number of circuits. It should be understood that this invention applies to similar coils having various numbers of rows of tubing and having various circuiting arrangements. It is to be further understood that this invention is not limited to the particular headering arrangement or the number of circuits as disclosed herein.

It is also to be understood that it is contemplated that this particular outdoor heat exchanger, as shown, would be a portion of a heat pump system. Consequently, this outdoor heat exchanger would serve as the evaporator during the heating mode of operation and as the condenser during the cooling mode of operation. In the heating season the refrigerant is evaporated in the outdoor heat exchanger absorbing heat energy from the air flowing thereover. It is in the heating mode that frost may accumulate on the heat exchange surfaces. In the cooling mode of operation, also being the defrost mode, hot gaseous refrigerant is supplied to the outdoor heat exchanger wherein it is condensed to a liquid giving up heat energy to air flowing thereover. In the defrost mode the hot gaseous refrigerant is condensed to transfer heat energy to the heat exchanger surfaces to melt the accumulated ice.

Figure 1:
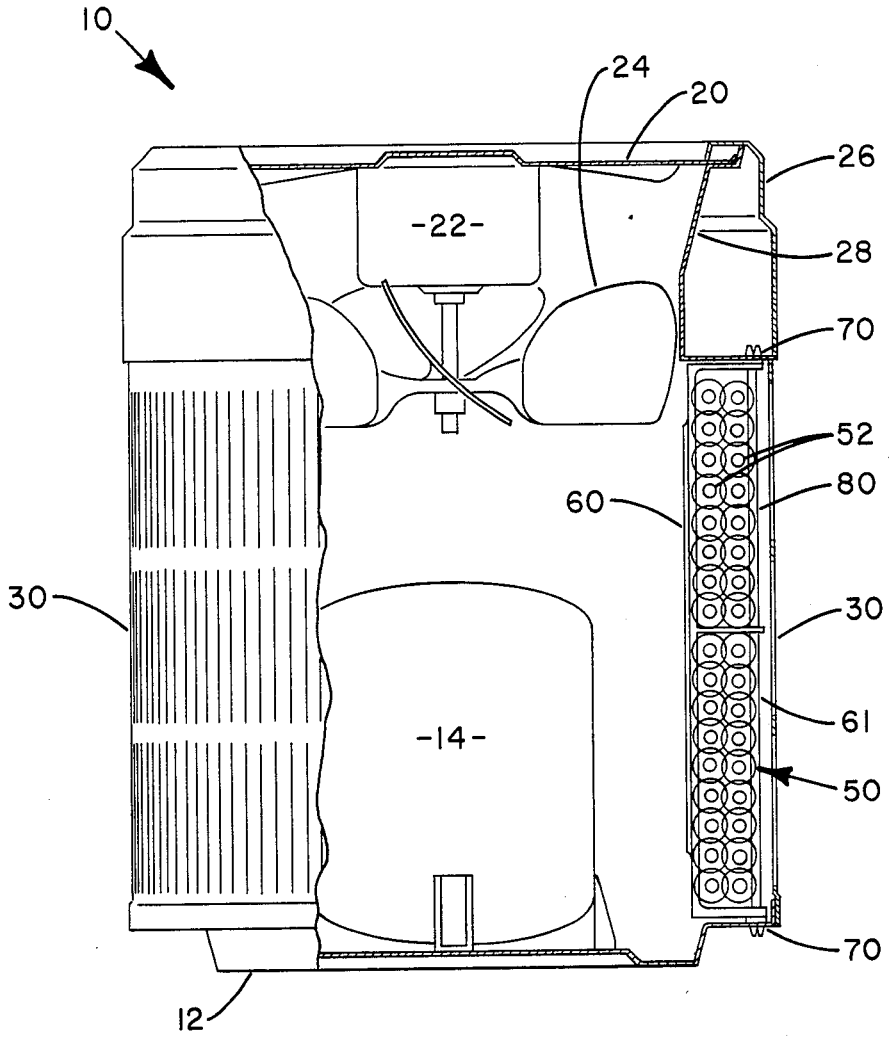
FIG. 1 is a partially cutaway view of an outdoor unit of an air conditioning system showing a wrapped fin heat exchanger.

Referring first to FIG. 1, there may be seen a heat exchange unit 10 having a base pan 12 to which compressor 14 is mounted. Heat exchanger 50 is shown having a plurality of loops 52 of wrapped fin tubing. Loops 52 are maintained in alignment via a tube support 60 and tube 61 which act to maintain the various loops therebetween. Pins 70 are mounted at the ends of tube 61 to secure the tube within the tube support. Pins 70 are also shown for securing the tube support to base pan 12 and to fan orifice 28. Fan orifice 28 is mounted about the top of the heat exchanger and defines the air flow surfaces which cooperate with fan 24 driven by motor 22. Top cover 26 fits over fan orifice 28 and defines the exterior surface of the unit. Top discharge grille 20 is mounted at the top of the unit and contains openings for allowing air flow therethrough. Louver grille 30 is mounted about the circumference of the unit and allows air flow to enter the unit. When fan 24 is operated via motor 22, air is drawn into the heat exchanger through louver grille 30 and through the various loops of wrapped fin tubing. Air is then discharged upwardly from the unit out the top discharge grille.

Figure 2:
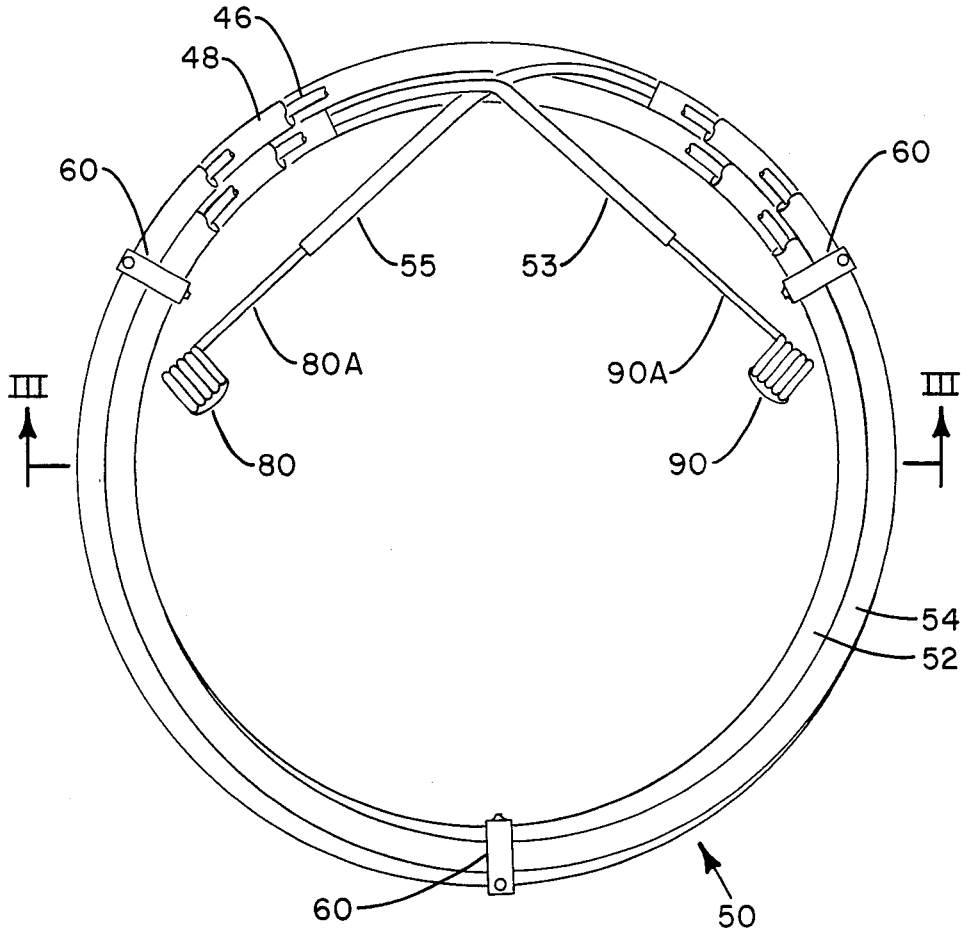
FIG. 2 is a top view of the wrapped fin heat exchanger and headers.

Referring now to FIG. 2, there can be seen a top view of a cylindrical wrapped fin heat exchanger. The heat exchanger, as shown, has tube supports 60 mounted at three locations thereabout for securing the various loops of tubing in position Each loop may be seen having a tube 46 extending about the circumference of the heat exchanger. Each tube has fins 48 wrapped about the tube to form an enhanced heat transfer surface. Typically, refrigerant flows through the tube and air flows thereover such that the fins provide a greater heat transfer surface in contact with the air.

First header 80 is shown connected via connecting tube 80A to a portion of tubing labeled 55. This portion of the outer row 55 has been bent inwardly to form the connection with the connecting portion to the header. Similarly, second header 90 is shown having a connecting portion 90A connected to a portion of the inner row tube 53, said inner row portion being bent from the inner row or inner set of loops. Specifically, it may be seen that the inner row of loops is referenced by numeral 52 and the outer row of loops is referenced by numeral 54.

Figure 3:
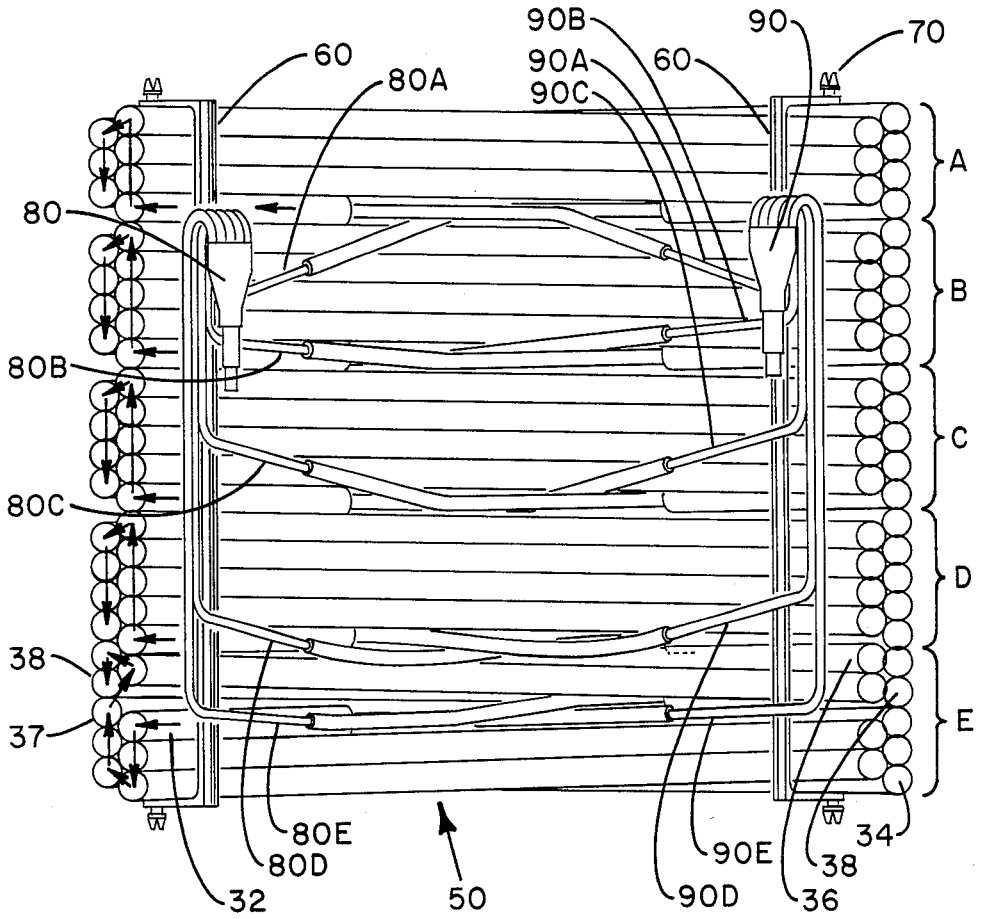
FIG. 3 is a sectional view taken along line III—III of FIG. 2 of the heat exchanger.

FIG. 3 is a sectional view of FIG. 2 taken at line III—III. It may be seen in FIG. 3 that a multiple row heat exchanger is disclosed having both an inner row and an outer row of tubes. Specifically, it can be seen that tube supports 60 and pins 70 are mounted to secure the loops of tubing in a particular arrangement. Refrigerant carrying circuits A, B, C, D and E are designated on the right hand side of the drawing.

First header 80 and second header 90 are shown each being connected to each of the refrigerant circuits A through E. Specifically, connecting portions 80A, 80B, 80C, 80D and 80E each connect first header 80 to various circuits A through E. Second header 90 is connected by connecting portions, also referred to as feeder tubes, 90A, 90B, 90C, 90D and 90E, to refrigerant circuits A, B, C, D and E.

The arrows drawn on FIG. 3 are shown to reflect the direction of refrigerant flow during operation in the cooling mode. All five circuits are operated in parallel with the refrigerant flowing from second header 90 into the circuits, through the circuits and then being discharged from the circuits into first header 80. It can be seen in the top four circuits, refrigerant enters a bottom loop of the inner row, flows upwardly through the loops of the inner row, transfers to the outer row, flows downwardly through the loops of the outer row and is then directed back to first header 80. In the bottom circuit, it can be seen that refrigerant enters into an interior loop of the inner row of loops, flows downwardly to a bottom transition loop 34 which connects the inner row or inner set of loops to the outer row or outer set of loops. Refrigerant then flows upwardly through the outer set of loops to an intermediate transition loop 37. Refrigerant then flows upwardly through the inner set of loops to a top transition loop 36 and then downwardly through the outer set of loops to loop 38 which is connected to first header 80 such that refrigerant is discharged from the circuit. The interior loop receiving refrigerant from second header 90 is designated as intermediate start loop 32. The exterior loop discharging refrigerant to first header 80 is designated as intermediate stop loop 38.

As may be seen in FIG. 3, the refrigerant being directed to loop E enters through intermediate start loop 32 and then proceeds downwardly to the bottom of the circuit and upwardly along the outer row. Since the highest frost accumulation occurs at the bottom of the heat exchanger, the circuiting of this bottom circuit allows for the hot gaseous refrigerant during the defrost or cooling mode to enter the intermediate start loop 32 and then flow downwardly into the area of the highest frost accumulation first. Hence, when the refrigerant entering the circuit E contains the most heat energy it is directed first to the areas of the highest frost accumulation and then directed upwardly along the exterior surface before flowing back to the interior row. From the interior row the refrigerant flows upwardly through the top transition loop and then downwardly through the outer row to intermediate stop loop 38 before it is circuited back to first header 80. Hence, by this headering and circuiting arrangement the hot gaseous refrigerant is directed to the areas of highest frost accumulation first.

By directing hot gaseous refrigerant to the areas of the highest frost accumulation it is hoped to reduce the overall period of time involved in defrost of the heat exchanger. Since, when frost accumulates on the heat exchange surfaces, the transfer of heat energy from the refrigerant flowing through the tube to the air flowing over the tube is reduced it is important for obtaining overall system efficiency to accomplish defrost prior to the heat exchanger efficiency degrading beyond a selected point. Since heat energy is removed from the space to be conditioned during reverse cycle defrost, as contemplated herein, it is further desirable to maintain the defrost period as short as possible. Hence by providing this circuiting arrangement it is hoped to reduce the length of the defrost period and hence reduce the amount of heat energy transferred from the space to be conditioned to the exterior to accomplish defrost. By reducing this length the overall seasonal efficiency of the heat exchanger is improved. Of course, if a non-reverse cycle defrost is used the air conditioning system does not act to supply heat energy to the heat exchanger from the space during defrost. However, under these circumstances, it is also advantageous to minimize the time spent in the defrost mode of operation.

The quantity of heat transferred between the refrigerant flowing through the loops of tubing and the air flowing thereover is a function of the temperature difference between the two fluids. Hence, to maintain this temperature difference at a maximum the refrigerant flows typically through the inner loops first and then through the outer loops. The outer loops receive the air which is rejecting heat first therefore providing a greater temperature difference between the air and the partially evaporated refrigerant. It is for this reason that refrigerant circuit E has its loops arranged firstly to promote defrost and thereafter to promote heat transfer. The upper loops are arranged such that the loops forming the end of the circuit are exterior loops to maximize the temperature differential and hence maximize the heat transfer rate.

Although the invention has been described with reference to a particular embodiment thereof it is to be understood that modifications and variations can be effected within the spirit and scope of the invention by those skilled in the art.

What is claimed is:

1. A refrigerant carrying circuit forming a portion of an air to refrigerant heat exchanger having a plurality of refrigerant carrying circuits connected to a first header means and a second header means in parallel which portion comprises:

a plurality of loops of tubing, each loop extending about the perimeter of the heat exchanger and the tubing being a wrapped fin tubing having a refrigerant carrying tube and fin material wrapped about the exterior of the tube;

an outer portion of the circuit formed from a set of loops located to form an outer set of loops including a top, a bottom and a plurality of intermediate loops;

an inner portion of the circuit formed from a set of loops located within said outer set of loops to form an inner set of loops including a top, a bottom and a plurality of intermediate loops and spaced inwardly from the outer set of loops;

said first header means connected to one of said intermediate loops of said inner set of loops;

said second header means connected to one of said intermediate loops of said outer set of loops; and transition means connecting the outer set of loops to the inner set of loops at the top, at the bottom and at an intermediate loop of each set of loops wherein refrigerant is supplied from the first header means to said one intermediate loop of said inner set of loops first and then flows downwardly through the inner set of loops to the transition means connecting said bottoms and then upwardly through the outer set of loops to the transition means connecting said intermediate loops of each set of loops and then upwardly through a portion of the inner set of loops to the transition means connecting said tops and then downwardly through the outer set of loops to the connection to the second header means.

* * * * *